US007131745B2

(12) United States Patent
Sibbett

(10) Patent No.: US 7,131,745 B2
(45) Date of Patent: Nov. 7, 2006

(54) MOUNTABLE ILLUMINABLE DISPLAY

(76) Inventor: Gary M. Sibbett, 1308 Echo Creek St., Henderson, NV (US) 89052

( * ) Notice: Subject to any disclaimer, the term of this patent is extended or adjusted under 35 U.S.C. 154(b) by 36 days.

(21) Appl. No.: 10/835,199

(22) Filed: Apr. 29, 2004

(65) Prior Publication Data

US 2005/0243541 A1 Nov. 3, 2005

(51) Int. Cl.
*F21V 21/084* (2006.01)

(52) U.S. Cl. ..... 362/106; 362/154

(58) Field of Classification Search ..... 362/106, 362/103, 104, 105, 108, 154
See application file for complete search history.

(56) References Cited

U.S. PATENT DOCUMENTS

| | | | | |
|---|---|---|---|---|
| 2,492,034 | A * | 12/1949 | Clyne | 362/99 |
| 4,667,274 | A * | 5/1987 | Daniel | 362/106 |
| 4,977,695 | A | 12/1990 | Armbruster | |
| 4,999,936 | A | 3/1991 | Calamia et al. | |
| 5,111,366 | A | 5/1992 | Rife et al. | |
| 5,143,440 | A * | 9/1992 | Trampota | 362/156 |
| 5,456,032 | A | 10/1995 | Matsumoto et al. | |
| 5,479,325 | A | 12/1995 | Chien | |
| 5,502,903 | A | 4/1996 | Barker | |
| 5,508,899 | A | 4/1996 | McCormick | |
| 5,517,345 | A | 5/1996 | Joaille | |
| 5,704,705 | A | 1/1998 | Chien | |
| 5,801,542 | A | 9/1998 | Kajiwara et al. | |
| 5,829,063 | A | 11/1998 | Cheng | |
| 5,845,987 | A | 12/1998 | Painter | |
| 6,086,213 | A | 7/2000 | Holce | |
| 6,132,059 | A * | 10/2000 | Leibowitz | 362/156 |
| 6,190,026 | B1 | 2/2001 | Moore | |
| 6,626,009 | B1 * | 9/2003 | Ohlund | 63/3.1 |
| 2001/0004808 | A1 | 6/2001 | Hurwitz | |
| 2003/0016327 | A1 | 1/2003 | Kotchick et al. | |
| 2004/0109313 | A1 * | 6/2004 | Smith | 362/240 |

* cited by examiner

*Primary Examiner*—John Anthony Ward
*Assistant Examiner*—Mark Tsidulko
(74) *Attorney, Agent, or Firm*—Jeffrey Weiss; Harry M. Weiss; Weiss & Moy, P.C.

(57) ABSTRACT

A mountable illuminable display. An illuminable device housing is mounted within an aperture in a mounting surface. Mounting is accomplished by a groove or protrusion in the housing engaging the mounting surface or by a retaining element fastened to the housing to contact the mounting surface.

2 Claims, 3 Drawing Sheets

MOUNTABLE ILLUMINABLE DISPLAY

RELATED APPLICATION

This application is related to the utility patent application filed concurrently herewith in the name of the same inventor entitled "MODULAR LIGHTED DISPLAY AND METHOD THEREFOR."

FIELD OF THE INVENTION

This invention relates generally to illuminable displays, and more particularly, to illuminable displays that may be attached to an article of manufacture.

DESCRIPTION OF THE RELATED ART

Lighted displays; which provide an illuminated design on an otherwise un-illuminated surface have become increasingly popular. Because of the attention attracted by an illuminated sign or design, illuminated displays have found uses in safety equipment, commercial advertisements, personal fashion, and many other applications. Frequently, such devices provide colorful designs and feature additional effects such as a flashing behavior to attract additional attention.

Typically, lighted displays are of an electroluminescence (EL) type or of a light emitting diode (LED) type. EL technology provides the benefits of high efficiency, flexible materials, and providing a plane solid light source. LED displays typically use a colorful surface having one or more LEDS positioned on the surface to attract additional attention, or have one or more LEDs under a translucent film having a design for a back-lighting effect as the LED emits light through the translucent film.

Lighted displays have been mounted on or built into items such as headwear, shoes, jewelry, and promotional-type materials such as coffee mugs and memo pad holders that are typically given away to consumers to promote a product or service. However, items manufactured with displays are limited by only having the capacity for use with the display provided, and manufacturers incur significant costs in designing and manufacturing such displays into each item to be manufactured.

Additionally, lighted displays that are mounted on or built into items by the manufacturer suffer the drawback that the lighted display is not easily removable by the consumer. As a result, the consumer must spend much time or effort to remove or replace the lighted display, such as when it malfunctions. Similarly, articles of clothing having an attached lighted display are not easily washed, as typically the lighted displays are stitched into place and are not waterproof.

A need therefore exists to provide a lighted display that overcomes these limitations and disadvantages of present lighted displays. Specifically, a need exists to reduce the cost of manufacture of multiple items featuring common displays. A need also exists to reduce the cost of remanufacturing an item already having a lighted display to provide a different lighted display. A need also exists to reduce the cost to consumers for removing or replacing a lighted display on an item the consumer already uses.

The present invention satisfies these needs, and provides other, related, advantages.

SUMMARY OF THE INVENTION

The foregoing objectives are achieved in the mountable illuminable display.

In accordance with one embodiment of the present invention, an electronically illuminable device for use with a mounting surface having a front portion and a back portion and having an aperture located within at least one of said front portion and said back portion is disclosed. It comprises, in combination: a housing having a front housing portion, a back housing portion, and a peripheral portion connecting the front housing portion and the back housing portion; an illuminable element proximate the front housing portion of the housing; and means for at least one of attaching and removably attaching the housing within the aperture of the mounting surface to restrict a frontward motion of the housing relative to the mounting surface.

In accordance with another embodiment of the present invention, a mounted electronically illuminable device is disclosed. It comprises, in combination: a mounting surface having a front portion and a back portion and having an aperture located in at least one of the front portion and said back portion; an illuminable device having a housing and an illuminable element, the housing having a front housing portion, a back housing portion, and a peripheral portion connecting the front housing portion and the back housing portion, the illuminable element being located proximate the front housing portion; and means for at least one of attaching and removably attaching the housing within the aperture of the mounting surface to restrict a frontward motion of the housing relative to the mounting surface.

In accordance with another embodiment of the present invention, a mounted electronic driver device for a modular illuminable display is disclosed. It comprises, in combination: a mounting surface having a front portion and a back portion and having an aperture located in at least one of the front portion and the back portion; an electronic driver device housing for a modular illuminable display, the housing having a front housing portion, a back housing portion, and a peripheral portion connecting the front housing portion and the back housing portion; and means for at least one of attaching and removably attaching the device housing within the aperture of the mounting surface to restrict a frontward motion of the housing relative to the mounting surface.

DESCRIPTION OF EMBODIMENTS OF THE INVENTION

Figure 1B:
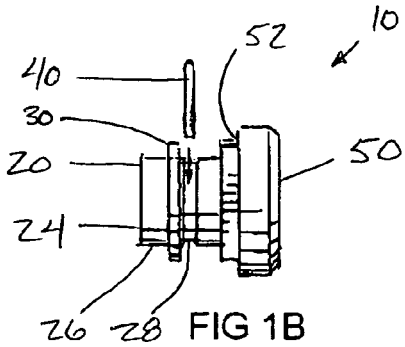
FIG. 1B is an illustration depicting a side view of a lighted display having a grooved housing and the retaining piece of FIG. 1 in accordance with a preferred embodiment of the present invention.
Figure 1A:
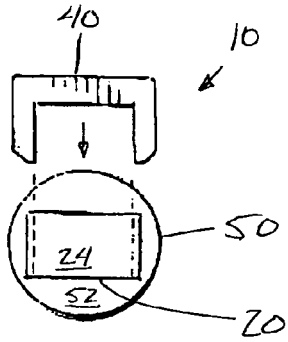
FIG. 1A is an illustration depicting a back view of the grooved housing and retaining piece of FIG. 1 in accordance with a preferred embodiment of the present invention.
Figure 1:
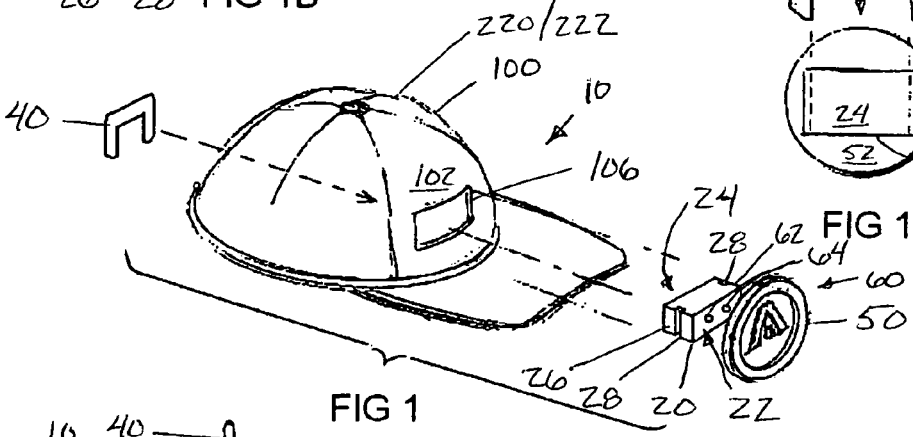
FIG. 1 is a an illustration depicting a perspective exploded view of a modular lighted display having a grooved housing, a retaining piece, an illuminable element, and a mounting surface having an aperture on a hat in accordance with a preferred embodiment of the present invention.

With reference now to the figures, and in particular to FIG. 1, an electronically illuminable device 10 for use with a mounting surface 100 is depicted in accordance with an embodiment of the present invention. The mounting surface 100, illustrated in FIG. 1 as a frontward surface of a hat, has a front portion 102, a back portion 104, and has an aperture 106 located within at least one of the front portion 102 and the back portion 104. The illuminable device 10 comprises, in combination: a housing 20 having a front housing portion 22, a back housing portion 24, and a peripheral portion 26 connecting the front housing portion 22 and the back housing portion 24; an illuminable element 50 proximate the front housing portion 22; and means for at least one of attaching and removably attaching the housing 20 within the aperture 106 of the mounting surface 100 to restrict a frontward motion of the housing 20 relative to the mounting surface 100.

By providing means for attaching the housing 20 within the aperture 106 of the mounting surface 100, the present invention provides the advantage of allowing separate manufacture and later assembly of items having a mounting surface 100 and of illuminable devices 10. Greater efficiency and lowered cost of production may be achieved by using standard dimensions for housings 20 for illuminable devices 10 and also apertures 106 in mounting surfaces 100 for interchangeability of components. In addition, significant benefit may be obtained by the increased flexibility resulting from to the interchangeable components of the assembled product. For example, a producer may ship a variety of mounting surfaces 100 and a variety of lighted displays 10 to a retail store for final assembly to conform to customers' particular preferences. Furthermore, by providing means for removably attaching the housing 20 within the aperture 106 of the mounting surface 100, a user of the illuminable device 10 may remove the illuminable device 10 from the mounting surface 100, for example, to replace or repair illuminable device 10 or to clean the mounting surface 100.

FIGS. 1A and 1B depict an embodiment of the present invention wherein the attaching means comprises a retaining piece 40 and a groove 28 defined by the peripheral portion 26 of the housing 20. The retaining piece 40 is dimensioned to slidably engage the groove 28 so that a frontward motion of the housing 20 is restricted by the retaining piece 40 contacting the back portion 104 of the mounting surface 100.

Figure 1C:
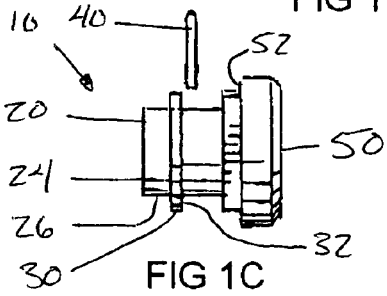
FIG. 1C is an illustration depicting a side view of a lighted display having a housing with protrusions and the retaining piece of FIG. 1 in accordance with a preferred embodiment of the present invention.

FIG. 1C depicts another embodiment of the present invention wherein the attaching means comprises a retaining piece 40 and a protrusion 30 proximate the peripheral portion 26 of the housing 20. The retaining piece 40 is dimensioned to couple to the peripheral portion 26 of the housing 20 between the protrusion 30 and the mounting surface 100 so that a frontward motion of the housing 20 is restricted by the retaining piece 40 contacting both the back portion 104 of the mounting surface 100 and a front surface 32 of the protrusion 30.

Although in FIGS. 1, 1A, 1B, and 1C, the retaining element 40 is substantially U-shaped and the peripheral portion 26 of the housing 20 has a substantially rectangular cross-section with protrusions 30 or grooves 28 on opposing sides, it should be understood that it is within the spirit and scope of the present invention the retaining element 40 not be substantially U-shaped and the peripheral portion 26 of the housing 20 not having a substantially rectangular cross-section, as long as the retaining element 40 is capable of restricting a frontward motion of the housing 20 by contacting a back portion 104 of the mounting surface 100. For example, the housing 20 may have a cross-section that is substantially circular or of any other shape, and the retaining piece may be of any appropriate shape to engage the grooves 28 or protrusions 30 of the housing 30.

Futhermore, although the FIGS. 1, 1A, 1B, and 1C depict either two protrusions 30 or two grooves 28 on opposing sides of the peripheral portion 26 of the housing 20, it is within the spirit and scope of the present invention that the protrusions 30 or grooves 28 are not on opposing sides of the peripheral portion 26 of the housing 20, as long as the grooves 28 or protrusions 30 are capable of preventing frontward motion of the housing 20 by restraining a motion of the retaining element 40 relative to the housing 20. For example, the peripheral portion 26 of the housing 20 may define a single groove 28, or multiple grooves 28, or have a single protrusion 30 or multiple protrusions 30, or any combination thereof.

Figure 2:
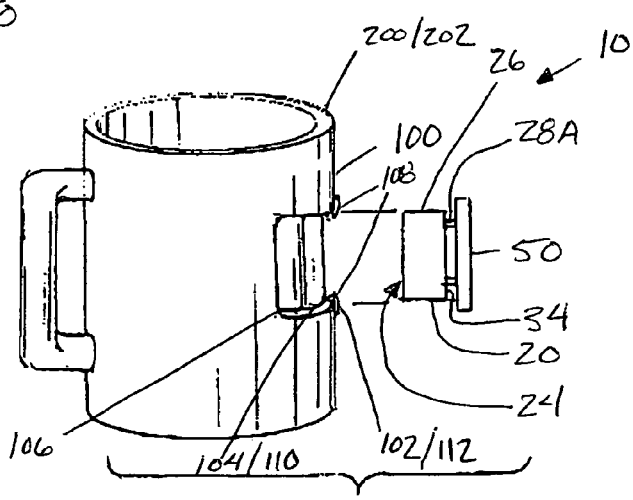
FIG. 2 is an illustration depicting a partially perspective exploded view of a lighted display with a grooved housing and a mounting surface with an aperture on a cup in accordance with a preferred embodiment of the present invention.

FIG. 2 depicts another embodiment of the present invention wherein the attaching means comprises a groove 28A defined by at least a portion of the peripheral portion 26 of the housing 20 for engaging a portion 108 of the aperture 106 of the mounting surface 100 so that a frontward motion of the housing 20 is restricted by a back surface 34 of the groove 28A contacting the back portion 104 of the mounting surface 100.

Figure 3:
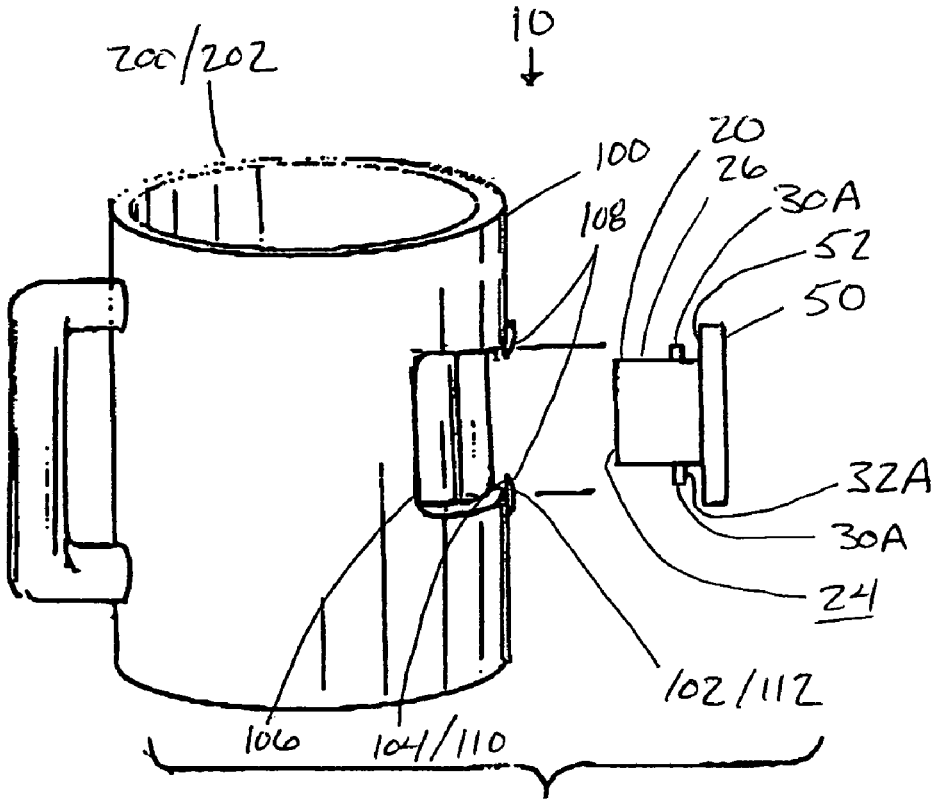
FIG. 3 is an illustration depicting a partially perspective exploded view of a lighted display with a housing having protrusions and a mounting surface with an aperture in accordance with a preferred embodiment of the present invention.

FIG. 3 depicts another embodiment of the present invention wherein the attaching means comprises a protrusion 30A proximate the peripheral portion 26 of the housing 20 so that a frontward motion of the housing 20 is restricted by a front surface 32A of the protrusion 30A contacting the back portion 104 of the mounting surface 100.

The mounting surface in FIGS. 2 and 3 have an inwardly-protruding portion 108 of the aperture 106 for engaging either the groove 28A or the front portion 32A of the protrusion 30A on the housing 20. Preferably, the portion 108 of the aperture 106 that engages the groove 28A or the front portion 32A of the protrusion 30A on the housing 20 is of a resilient material having a flat back portion 110 and an angled front portion 112. The housing 20 may then be securely attached by inserting the housing 20 from the front of the aperture 100. When the housing 20 or the protrusions 30A contact the angled front portion 112 of the protruding portion 108 of the aperture 100, the protruding portions 108 of the aperture 100 will flex in a backward direction to further accommodate the housing 20. When the housing 20 is inserted so that the back surface 34 of the groove 28A or the front portion 32A of the protrusion 30A engages the back portion 104 of the protruding portions 108 of the aperture 100, the flat back portion 110 of the protruding portions 108 of the aperture 100 restrict a subsequent frontward motion in the manner previously described.

However, it should be clearly understood that the aperture 100 need not have inwardly protruding portions 108, as long the groove 28A or the protrusion 30A is capable of preventing a frontward motion of the housing 20 by contacting a back portion 104 of the mounting surface 100. This may be accomplished, for example, by the aperture 100 being dimensioned so that the housing 20 is insertable at one orientation but engages the aperture 106 at another orientation. As another example, the housing may instead be inserted from the back of the aperture 100.

Additionally, the attaching means may comprise other mechanisms not depicted in the Figures to prevent a frontward movement of the housing 20, such as magnets, adhesives, hook and loop material, threaded fasteners, or frictional contact elements such as snaps or clips, for example.

Preferably, at least one of the front housing portion 22 and the illuminable element 50 is dimensioned so that a backward motion of the housing 20 is restricted by the front portion 102 of the mounting surface 100 contacting a back surface 52 of at least one of the front housing portion 22 and the illuminable element 50. FIGS. 1, 2, and 3 depict the illuminable device 10 having the illuminable element 50 larger than the aperture 106 of the mounting surface 100 to prevent a backward motion of the housing 20 is prevented by a contact with the front portion 102 of the mounting surface 100. However, it should be understood that substantial benefit may be obtained by not having a forward motion of the housing 20 not be restricted by the front portion 22 of the housing 20 or the illuminable element 50 contacting a front portion 102 of the mounting surface 100, or not be restricted at all. For example, a backward motion of the housing 20 may be restricted by any one or more of the attaching means disclosed above for preventing a frontward motion, adapted to prevent a backward motion, such as having protrusions or grooves (not shown) to engage a retaining element on a front side of the mounting surface 100, or to contact a front portion 102 of the mounting surface 102.

In another embodiment of the present invention, a mounted electronic driver device 62 for a modular illuminable display 60 comprises, in combination: a mounting surface 100 having a front portion 102 and a back portion 104 and having an aperture 106 located in at least one of the front portion 102 and the back portion 104; an electronic driver device housing 20 for a modular illuminable display 60, the housing 20 having a front housing portion 22, a back housing portion 24, and a peripheral portion 26 connecting the front housing portion 22 and the back housing portion 24; and means for at least one of attaching and removably attaching the device housing 20 within the aperture 106 of the mounting surface 100 to restrict a frontward motion of the housing 20 relative to the mounting surface 100. As depicted in FIG. 1, an illuminable element 50 of the illuminable display 60 may be modularly attached to or removed from the electronic device driver housing 20, and may receive a electrical signal from the electronic device driver 62 via electrical contacts 64. The housing 20 of the device driver 62 may be attached or removably attached to the mounting surface 100 as desired. This embodiment of the present invention allows a merchant to provide a supply of mounting surfaces 100 having attached electronic device drivers 62 that may interchangeably be equipped with illumination elements 50 by the provider, reseller, or customer.

Preferably, the mounting surface 100 is an exterior surface of at least one of a promotional-type item 200, a collectable-type item 210, an article of clothing 220, and an article of jewelry 230. These categories of items share the common characteristic of being items of personal use commonly provided with lighted displays for attention-commanding effects on observers.

FIG. 1 depicts an embodiment of the present invention wherein the mounting surface 100 is an exterior surface of an article of clothing 220. In FIG. 1, the article of clothing 220 is a hat 222. The exterior surface of other articles of clothing 220 may be used as a mounting surface 100, including, but not limited to, sweatshirts, shoes, shoelaces, belts, neckties, jackets, and helmets.

Figure 5:
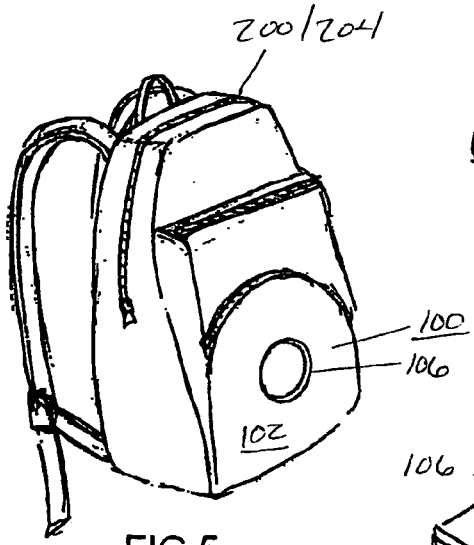
FIG. 5 is a perspective view of a mounting surface on a backpack in accordance with a preferred embodiment of the present invention.
Figure 6:
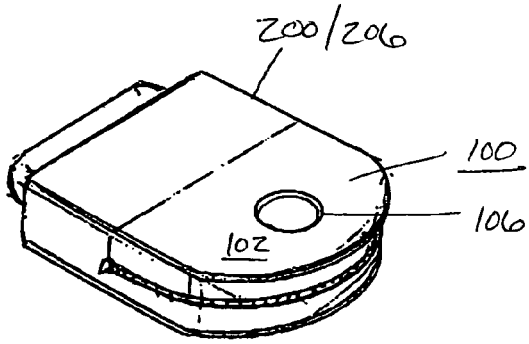
FIG. 6 is a perspective view of a mounting surface on a compact disc case in accordance with a preferred embodiment of the present invention.
Figure 7:
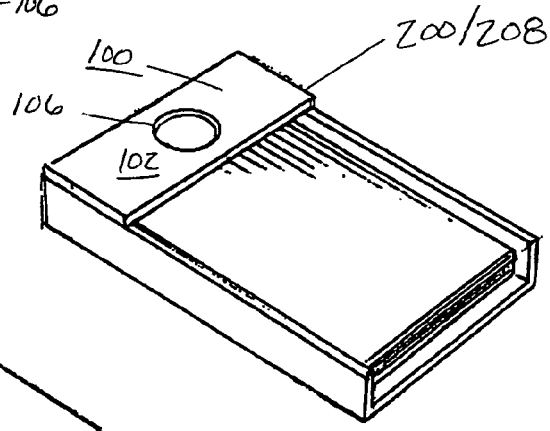
FIG. 7 is a perspective view of a mounting surface on a memo pad container in accordance with a preferred embodiment of the present invention.

FIGS. 2, 3 and 5–7 depict embodiments of the present invention wherein the mounting surface 100 is an exterior surface of a promotional-type item 200. These items share the common characteristic of frequently being given by companies to potential customers as a means of promoting or advertising the companies' products or services. In FIGS. 2 and 3, the promotional-type item 200 is a cup 202. In FIG. 5, the promotional-type item 200 is a backpack 204. In FIG. 6, the promotional-type item 200 is a compact disc carrying case 206. In FIG. 7, the promotional-type item 200 is a memo pad container 208. The exterior surface of other promotional-type items 200 may be used as a mounting surface 100, including, but not limited to, mugs and coffee cups, sports bottles, notebooks, briefcases, sports bags, name tags, Christmas ornaments, cell phone cases, and other common office products such as mouse pads.

Figure 4:
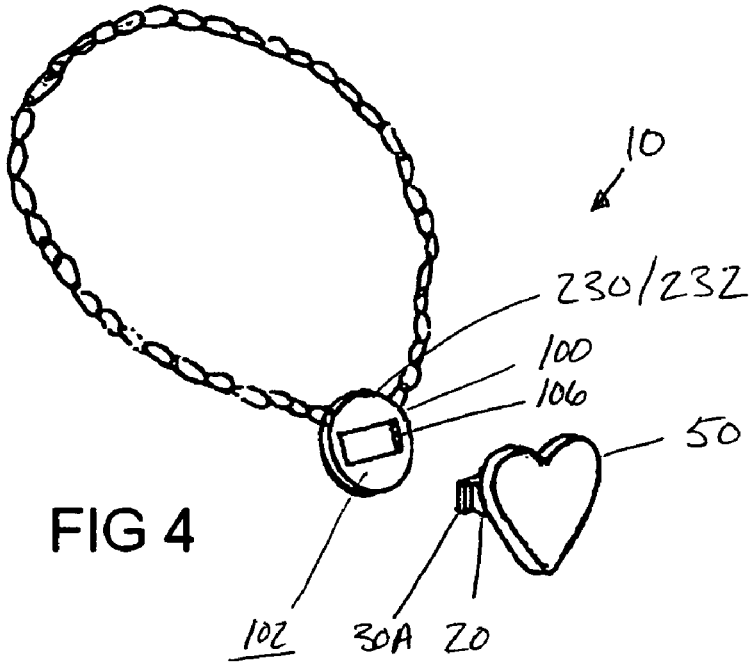
FIG. 4 is an exploded perspective view of a lighted display with a housing having protrusions and a mounting surface on a pendant in accordance with a preferred embodiment of the present invention.

FIG. 4 depicts an embodiment of the present invention wherein the mounting surface 100 is an exterior surface of an article of jewelry 230. In FIG. 4, the article of jewelry 230 is a pendant 232 on a necklace. The exterior surface of other articles of jewelry 230 may be used as a mounting surface 100, including, but not limited to, watches, rings, bracelets and earrings.

Figure 8:
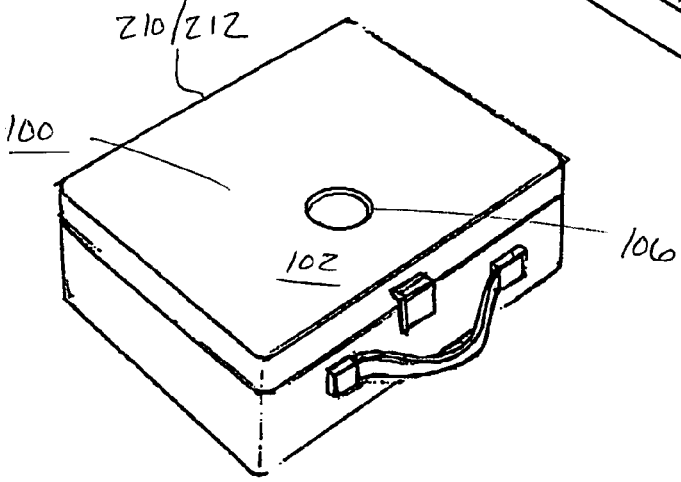
FIG. 8 is a perspective view of a mounting surface on a lunchbox in accordance with a preferred embodiment of the present invention.

FIG. 8 depicts an embodiment of the present invention wherein the mounting surface 100 is an exterior surface of a collectable-type item 210. In FIG. 8, the collectable-type item 210 is a lunchbox 212. The exterior surface of other collectable-type items 210 may be used as a mounting surface 100, including, but not limited to, picture frames, trophies, toys, bookmarks, keychains, purses and handbags, snow globes, badges, and containers such as cookie jars, jewelry boxes, piggy banks, and vases.

While the invention has been particularly shown and described with reference to the preferred embodiments thereof, it will be understood by those skilled in the art that the foregoing and other changes in form, and details may be made therein without departing from the spirit and scope of the invention. For example, the device housing 20 and corresponding aperture 106 in the mounting surface 100 may be of any desirable shape, such as circular. As another example, a mounting surface 100 may define multiple apertures 106 for use with one or more illuminable displays.

What is claimed is:

1. An electrically illuminable device for use with a mounting surface having a front portion and a back portion and having an aperture located within at least one of said front portion and said back portion, comprising in combination:

a housing having a front housing portion, a back housing portion, and a peripheral portion connecting said front housing portion and said back housing portion;

an illuminable element proximate the front housing portion of said housing; and means for at least one of attaching and removably attaching said housing within the aperture of the mounting surface to restrict a frontward motion of said housing relative to the mounting surface, said attaching means comprises a retaining piece and a protrusion proximate said peripheral portion of said housing, said retaining piece is dimensioned to couple to said peripheral portion of said housing between said protrusion and the mounting surface so that a frontward motion of said housing is restricted by said retaining piece contacting both the back portion of the mounting surface and a front surface of said protrusion.

2. The device of claim 1 wherein at least one of the front housing portion and said illuminable element is dimensioned so that a backward motion of said housing is restricted by the front portion of the mounting surface contacting a back surface of at least one of said front housing portion and said illuminable element.

* * * * *